United States Patent [19]

Nishiyama

[11] Patent Number: 5,013,708

[45] Date of Patent: May 7, 1991

[54] PRESSURE-SENSITIVE RECORDING SHEET AND COATING MATERIAL THEREFOR

[75] Inventor: Fumio Nishiyama, Tokyo, Japan

[73] Assignee: Jujo Paper Co., Ltd., Tokyo, Japan

[21] Appl. No.: 426,740

[22] Filed: Oct. 24, 1989

[30] Foreign Application Priority Data

Dec. 24, 1988 [JP] Japan ..... 63-326935

[51] Int. Cl.[5] ..... B41M 5/165

[52] U.S. Cl. ..... 503/213; 106/21; 503/215; 503/225

[58] Field of Search ..... 427/150–152; 503/213, 215, 225, 226; 106/21

[56] References Cited

FOREIGN PATENT DOCUMENTS 0156788 9/1984 Japan ..... 503/213

3130379 6/1988 Japan ..... 503/213

*Primary Examiner*—Bruce H. Hess

*Attorney, Agent, or Firm*—Koda and Androlia

[57] ABSTRACT

A coating material for a pressure-sensitive recording sheet comprises both microcapsules A and microcapsules B, wherein the microcapsules A contains a solvent $S_1$ which dissolves a colorless dye for a pressure-sensitive recording sheet, and the microcapsules B contains a dye-free solvent $S_2$ which has no ability of dissolving dye and which has a lower boiling point than the solvent $S_1$. The pressure-sensitive recording sheet using this coating material provides an improved thermal smudge without the deterioration of the image density, etc.

6 Claims, No Drawings

PRESSURE-SENSITIVE RECORDING SHEET AND COATING MATERIAL THEREFOR

BACKGROUND OF THE INVENTION

1. Field of the Invention

This invention relates to a pressure-sensitive recording sheet and a coating material therefor.

2. Prior Art

A pressure-sensitive recording sheet is referred to as non-carbon paper. Generally, pressure-sensitive recording sheets are composed of a top (CB: Coated Back) sheet, a middle (CFB: Coated Front and Back) sheet and a bottom (CF: Coated Front) sheet. The back surface of each of the top sheet and the middle sheet is coated with microcapsules containing a solution of leuco dye as a core substance.

The upper surface of each of the middle sheet and the bottom sheet is coated with a layer containing a color-developing agent composed of an acidic substance. They form a color upon the application of a writing, typewriter, mechanical pressure, thus permitting duplication of several copies.

The pressure-sensitive recording sheets have as a defect an unwanted color-forming at the occasion when a recording is unnecessary, which is undesirable for copying. Particularly, it is known that the hard readability (background-smudge) of letters which decreases the value of a pressure-sensitive recording sheet (as background-smudge) is caused by an unwanted color-forming under a severe thermal environment which occurs during the room- or warehouse-storage, the transport, or the press work for producing an account book. As preventive methods of an unwanted color-forming (i.e. the background-smudge) under thermal environments, there have been proposed a use of thick capsule wall, a method for protecting microcapsules by means of the addition of water soluble polymer or latex to the coating material containing microcapsules, and the like. However, the thick capsule wall requires a large amount of wall material, which increases the capsule-production costs. The addition of water-soluble polymer or latex increases the capsule-production costs, and further the excess addition reduces a color-forming property and has a bad effect on the function of a pressure-sensitive recording sheet, which is undesirable for the recording sheet.

The techniques similar to those of this invention are disclosed in Japanese Patent Laid-Open Application No. 62-267184 and in Japanese Patent Publication No. 53-21328. Japanese Patent Laid-Open Application No. 62-267184 discloses a pressure-sensitive recording sheet in which a substrate is coated with a mixture of microcapsules (1) containing a solvent which dissolves a colorless dye for a pressure-sensitive recording sheet, and of microcapsules (2) containing a dye-free solvent and having larger particles than microcapsules (1). The object of Japanese Patent Laid-Open Application No. 53-21328 consists in a counterplan against the smudge of sheet in the flow-out of the recording solvent by the rupture of microcapsules, that is, the counterplan of the smudge through the rupture of dye-free microcapsules (2) by rubbing, accidentally slight pressure, etc.

The solvent in microcapsules (2) having large particles is independent of the solvent in microcapsules containing dye, and it is an odorless solvent having high boiling point without preventing the color-development of a leuco dye.

In this case, it seems that the solvent in microcapsules (2) is the same as the solvent in microcapsules (1).

Japanese Patent Publication No. 53-21328 describes that microcapsules (1) contain a solution prepared by dissolving a colorless dye in a solvent having a weak affinity to a color-developing agent, and that microcapsules (2) contains a solvent having a strong affinity to a color-developing agent. The solvent having a strong affinity to a color-developing agent is the same as a solvent used in microcapsules A of this invention. The object of Japanese Patent Publication No. 53-21328 consists in the prevention of the smudge without the color-development by the rupture of one of two kinds of microcapsules through an outer pressure.

Each of the above Application and Publication does not describes about the thermal smudge, and the use of technologies in these Application and Publication as a counterplan against thermal smudge is insufficient or ineffective.

SUMMARY OF THE INVENTION

It is the first object of this invention to provide a pressure-sensitive recording sheet in which an unwanted color formation, that is, thermal smudge, is improved without the deterioration of the image density and the increase of the costs.

It is the second object of this invention to provide a coating material for the above pressure-sensitive recording sheet.

The above objects have been achieved by preparing a coating material of microcapsules A and another coating material of microcapsules B, and by coating or printing the two coating materials separately or together, wherein the microcapsules A contain a solvent $S_1$ which dissolves a colorless dye for a pressure-sensitive recording sheet, and the microcapsules B contain a dye-free solvent $S_2$ which has no ability of dissolving dye and which has a lower boiling point than the solvent $S_1$.

DETAILED DESCRIPTION OF THE INVENTION

The coating material of this invention can be coated on the entire surface of a substrate by a coater, or it can be printed on the partial surface of a substrate by a printer. The substrate of this invention can be paper, synthetic resin film, sheet and the like.

So long as the microcapsules A and B are used, the pressure-sensitive recording sheets of this invention are not particularly limited and are, for example, as follows: a CB-sheet prepared by applying a coating material of mixed microcapsules A and B on a surface of a fine paper; a CB-sheet prepared by coating on a surface of a fine paper a coating material of microcapsules A and that of microcapsules B in the recited order; a single-type sheet prepared by coating on a CB-sheet a coating material of color-developing agent; a CFB-sheet prepared by coating on a back side of a CF-sheet coating-materials of microcapsules A and B separately or together; a sheet prepared by coating on both surfaces of a fine paper the coating materials of microcapsules A and B separately or together; a sheet prepared by coating on a back side of the single-type pressure-sensitive recording sheet the coating materials of microcapsules A and B separately or together; and the like.

In the single-type pressure-sensitive recording sheet, both a coating material of mixed microcapsules A and B and a protective layer of a polymer film can be coated on a sheet coated with a color-developing agent, or a coating material composed of mixed microcapsules A and B and of other microcapsules containing a color-developing agent can be coated on a sheet coated with a color-developing agent. The solvent $S_1$ for dissolving the dye in a microcapsule A is a solvent having a high boiling point, a low odor and a less toxicity.

The solvent $S_1$ of this invention includes, for example, diarylalkane such as phenylxylylethane, phenylxylylmethan, phenylethylphenylethane and phenylbutylphenylmethane; alkylnaphthalene such as mono- or di-isopropylnaphthalene: alkylbiphenyl such as isopropylbiphenyl and butylbiphenyl: partially hydrogenated terphenyl: and the like.

The solvent $S_2$ in microcapsule B is a dye-free solvent which has no ability of dissolving a colorless dye, has a chemical constitution other than the solvent $S_1$ in microcapsule A and provides a lower boiling point than the solvent $S_1$. The solvent $S_2$ of this invention includes, for example, hydrocarbons of paraffin- and naphthene-series, alkyl benzene, and the like.

If the boiling point is too low, the encapsulation is difficult, and the obtained capsule wall is weak. Accordingly, the boiling point of this invention is preferably at least 100° C., more preferably at least 150° C. The upper limit of the boiling point of the solvent $S_2$ is depended upon the solvent $S_1$ in microcapsule A. It is effective that the solvent $S_2$ has an at least 10° C. (preferably at least 30° C.) lower boiling point than the solvent $S_1$.

As the colorless dye in the microcapsule A, many dyes described in Patent Publications can be used. The colorless dye of this invention includes, for example, 3,3'-bis-(p-dimethylaminophenyl)-6-dimethylaminophthalide (crystal violet lactone), 3-3-bis-(p-dimethylaminophenyl)phthalide, 3-(4-diethylamino-2-ethoxyphenyl)-3-(1-ethyl-2-methylindole-3-yl)-4-azaphthalide, di-(N-methyl-N-phenylanilino)carbazolylmathane, 3-diethylamino-6-methyl-7-anilinofluorane, 3-diethylamino-6-methyl-7-O-phenyl-dimethylanilinofluorane, and the like.

The capsule wall-forming material and the process for producing capsules used for the microcapsules A and B of this invention are not otherwise limited. The capsule wall-forming material includes, for example, gelatin, melamine/formaldehyde prepolymer, melamine/urea/formaldehyde prepolymer, condensed resin of urea/formaldehyde mixture under using an acidic catalyst, isocyanate/amine resin, isocyanate/-polyol resin, epoxide resin and the like. The process for producing microcapsules is a well-known method such as coacervation method, interfacial polymerization method, in situ polymerization method and the like.

The particle size of microcapsules has a great effect upon both the color-developing property and the smudge degree. The microcapsules A of this invention have a volume-average particle size of circa 3–15 μm, and the microcapsules B of this invention have a volume-average particle size of 2–10 μm, preferably 3–8 μm. In this invention, it is suitable to use 1–90 parts by weight, preferably 20–70 parts by weight, of microcapsules B containing only a solvent per 100 parts by weight of microcapsules A containing a dye-solution. With a smaller amount of microcapsules B, the effects of this invention is slight. With a larger amount of microcapsules B, the color-developing property, i.e. a fundamental function necessary for a pressure-sensitive recording sheet, is lowered.

This invention has the feature that a dye-dissolving solvent $S_1$ and a dye-free solvent $S_2$ having no ability of dissolving dye are individually encapsulated and exist separately. The reason for improving a thermal smudge by this invention is not clear. However, it is assumed as follows.

If the pressure-sensitive recording sheets coated with two kinds of microcapsules are laid under undesirable thermal conditions, the solvent $S_2$ in microcapsules B, i.e. that having a lower boiling point, is exposed and evaporated at first. In this case, the solvent $S_2$ causes no color-developing on the surface of a color-developing layer since it contains no dye. And the color-developing agent is surrounded by the solvent $S_2$ which can substantially dissolve no dye. Accordingly, the color-developing is not easy, even if the solvent $S_1$ dissolving dye in microcapsules A penetrates through the capsule-wall. Also, it is assumed that the thermal dye-smudge is improved or prevented. On the other hand, there is a method in which two kinds of the above solvents can be uniformly admixed and then encapsulated. In this method, the effects of this invention are not achieved and the recrystallization of dye occurs easily, which provides no practical advantage.

Hereinafter, this invention will be described by typical Examples and Comparative Examples. All parts and percentages are by weight.

Example 1

(1) Preparation of the microcapsules B containing a dye-free solvent having no ability of dissolving dye 10 parts of urea and 1.2 parts of resorcinol were dissolved in 180 parts of a 5% aqueous solution of acrylic acid/styrenesulfonic acid/ethyl acrylatecopolymer (monomer ratio of 85:8:7, molecular weight of circa 240000). A 20% aqueous solution of sodium hydroxide was added thereto to prepare a hydrophilic solution having a pH-value of 3.4. 105 parts of a hydrocarbon (boiling point: 206°–260° C.) of isoparaffin series were added under stirring to the hydrophilic solution to produce an O/W—type emulsion having an average particle size of 5 μm. 27 parts of formalin were added under continued stirring to the emulsion and heated to 55° C. After carrying out an encapsulation reaction at 55° C. for 3 hours, the temperature of the system was lowered to 40° C., and the reaction solution was adjusted to a pH-value of 7.5 by addition of 28% ammonia, wherein microcapsules B were obtained.

(2) Preparation of the microcapsules A containing a dye-solution 10 parts of urea and 1.2 parts of resorcinol were dissolved in 180 parts of a 5% aqueous solution of acrylic acid/styrene sulfonic acid/ethyl acrylatecopolymer (monomer ratio of 85:8:7, molecular weight of circa 240000). A 20% aqueous solution of sodium hydroxide was added thereto, whereby the hydrophilic solution was adjusted to a pH-value of 3.4.

125 parts of a 3.53% solution of Crystal Violet Lactone (CVL), which has been dissolved in Hisol SAS-296 (manufactured by Nisseki Kagaku Co., boiling point: 290°–310° C.), were added under strong stirring to the above hydrophilic solution to produce an emulsion having an average particle size of 5.0 μm.

27 parts of formalin were added under continued stirring to the emulsion and heated to 55° C. After carrying out an encapsulation reaction at 55° C. for 3 hours, the temperature of the system was lowered to 40° C., and the reaction solution was adjusted to a pH-value of 7.5 by addition of 28% ammonia, wherein microcapsules A were obtained.

(3) Preparation of the coating material

A dispersion of the microcapsules B obtained in (1) and a dispersion of the microcapsules A obtained in (2) were mixed in a mixed ratio of 15 to 85 (as solid). 20 parts of powdered starch were added to 150 parts of the mixed dispersion. The obtained mixed dispersion was diluted with water to 12% concentration, wherein a coating material for pressure-sensitive recording sheet was obtained.

(4) Preparation of a CB-sheet

The coating material obtained in above (3) was applied on one side of a base paper weighing 40 g/m$^2$ in a coating amount of 3.5 g/m$^2$ (as solid) by means of meyer bar, wherein a CB-sheet was obtained.

Evaluation

The above CB-sheet and the CF-sheet (NW-40 B, manufactured by JUJO PAPER CO., LTD.) are laid so that the coated surfaces of the sheets are contacted with each other. The superposed sheets are heat-treated under a pressure of 80 g/cm$^2$ at 105° C. for 16 hours. The smudge of microcapsules was evaluated by the smudge degree of the CF-sheet.

The reflectances of a CF-sheet before and after the heat-treatment were measured by a color-difference meter (Model TC-1500 MC, manufactured by Tokyo Denshoku Co.). The difference between the above reflectances is indicated as a thermal smudge degree.

The image density is determined as follows. The above superposed sheet are colored by means of a typewriter. An image density of sheet 1 hour after the color-developing is measured by means of a color-difference meter.

Example 2

A CB-sheet was prepared in the same manner as in Example 1 except that a 4.29% solution of Crystal Violet Lactone (CVL) described in (2) of Example 1 (Preparation of the microcapsules A containing a dye solution) and the microcapsules B and A in a mixed ratio of 30 to 70 described in (3) of Example 1 (Preparation of the coating material) were used.

Example 3

A coating material consisting of 40 parts of carboxylated terpenephenol resin, 100 parts of calcium carbonate, 10 parts of styrene-butadiene latex (40%) and 10 parts of oxidized starch was applied on one side of a base paper weighing 40 g/m$^2$ in a coating amount of 4.0 g/m$^2$ (solid base) by means of meyer bar. In this case, a single-type pressure-sensitive recording sheet was obtained.

Examples 4–7

CB-sheets were prepared in the same manner as in Example 1 except that the kinds of solvents for the microcapsules A and B, and the mixed ratios of A and B described in (1) and (2) of Example 1 are varied, as described in Table 1 (In this case, the preparation is made to obtain 3.00% solution of Crystal Violet Lactone after the mixing.)

Comparative Example 1

10 parts of urea and 1.2 parts of resorcinol were dissolved in 180 parts of a 5% aqueous solution of acrylic acid/styrenesulfonic acid/ethyl acrylatecopolymer (monomer ratio of 85:8:7, molecular weight of circa 240000). A 20% aqueous solution of sodium hydroxide was added thereto to prepare a hydrophilic solution having a pH-value of 3.4.

125 parts of a 3.00% solution of Crystal Violet Lactone (CVL), which has been dissolved in Hisol SAS-296, were added under strong stirring to the above hydrophilic solution to produce an emulsion having an average particle size of 5.0 μm.

27 parts of formalin were added under continued stirring to the emulsion and heated to 55° C. After carrying out an encapsulation reaction at 55° C. for 3 hours, the temperature of the system was lowered to 40° C., and the reaction solution was adjusted to a pH-value of 7.5 by addition of 28% ammonia, wherein microcapsules were obtained.

Then, 20 parts of powdered starch were added to 150 parts of this dispersion. The obtained dispersion was diluted with water to 12% concentration to obtain a coating material for pressure-sensitive recording sheet. By using the obtained coating material, a CB-sheet was prepared in the same manner as in Example 1.

Comparative Examples 2–5

A CB sheet was prepared in the same manner as in Comparative Example 1 except that the solvents of mixed ratios described in Table 1 were used.

Each of dye-solutions, which has been recrystallized in the bottom of the beaker, was encapsulated.

Comparative Examples 6–7

A CB-sheet was prepared in the same manner as in Example 4 except that the solvents as described in Table 1, were used as the solvents $S_1$ and $S_2$ for microcapsules A and B. CB-sheets of Comparative Examples 6–7 generate thermal smudge extremely.

Example 8

Microcapsules and a CB-sheet were prepared in the same manner as in Example 1 except that a 6.5% solution of 3-diethylamino-6-methyl-anilinofluorane was used instead of the solution of Crystal Violet Lactone in Example 1 (2), "Preparation of the microcapsules A containing a dye-solution".

Comparative Example 8

A CB-sheet was prepared in the same manner as in Comparative Example 1, except that the dye solution and the concentration thereof used in Example 8 were used instead of the dye solution of Comparative Example 1.

There is prepared a pressure-sensitive recording sheet which is obtained by coating or printing on a substrate a coating material of microcapsules A and that of microcapsules B separately or together, wherein the microcapsules A contain a solvent $S_1$ which dissolves a colorless dye for a pressure-sensitive recording sheet, and the microcapsules B contain a dye-free solvent $S_2$ which has no ability of dissolving dye and which has a lower boiling point than the solvent $S_1$. The resultant pressure-sensitive recording sheet has an improved thermal smudge without the deterioration of the image density, compared with conventional pressure-sensitive recording sheets.

TABLE 1

| | Solvent $S_1$ for Microcapsules A (boiling point) | Solvent $S_2$ for Microcapsules B (boiling point) | Mixed Ratio* | Smudge Degree | Image Density |
|---|---|---|---|---|---|
| Example 1 | Hisol SAS-296 (290–310° C.) | Isoparaffin (206–260° C.) | 85/15 | 6.9 | 62.9 |
| Example 2 | Hisol SAS-296 (290–310° C.) | Isoparaffin (206–260° C.) | 70/30 | 5.4 | 62.9 |
| Example 3 | Hisol SAS-296 (290–310° C.) | Isoparraffin (206–260° C.) | 85/15 | 7.2 | 64.0 |
| Example 4 | Hisol SAS 296 (290–310° C.) | Normalparaffin (223–244° C.) | 70/30 | 7.1 | 62.4 |
| Example 5 | KMC-R (287–305° C.) | Normalparaffin (185–214° C.) | 70/30 | 7.3 | 63.1 |
| Example 6 | Hisol SAS-296 (290–310° C.) | Naphthene series (214–232° C.) | 70/30 | 6.9 | 62.6 |
| Example 7 | KMC-R (287–305° C.) | Naphthene series (177–200° C.) | 70/30 | 7.3 | 62.5 |
| Comparative Example 1 | Hisol SAS-296 (290–310° C.) | — | — | 10.8 | 62.5 |
| Comparative Example 2 | Hisol SAS/Isoparaffin = 70/30 | — | — | 10.0 | 62.6 |
| Comparative Example 3 | Hisol SAS/Normalparaffin = 85/15 | — | — | 10.5 | 62.0 |
| Comparative Example 4 | Hisol SAS/Naphthen = 70/30 | — | — | 10.2 | 62.7 |
| Comparative Example 5 | KMC-R/Normalparaffin = 70/30 | — | — | 10.8 | 62.8 |
| Comparative Example 6 | Hisol SAS-296 | Hisol SAS-296 | 70/30 | 11.4 | 62.5 |
| Comparative Example 7 | KMC-R | KMC-R | 70/30 | 10.9 | 62.7 |
| Example 8 | Hisol SAS-296 | Isoparaffin | 85/15 | 6.9 | 64.9 |
| Comparative Example 8 | Hisol SAS-296 | — | — | 10.4 | 64.3 |

*Mixed ratio of microcapsules A to microcapsules B

I claim:

1. A coating material for a pressure-sensitive recording sheet which comprises both microcapsules A and microcapsules B, said microcapsules A having a volume-average particle size of circa 3–15 um and containing a colorless dye and a solvent $S_1$ which dissolves said colorless dye for a pressure-sensitive recording sheet, and said microcapsules B having a volume-average particle size of circa 2–10 um and containing a dye-free solvent $S_2$ which has no ability of dissolving dye and which has a lower boiling point than said solvent $S_1$.

2. The coating material according to claim 1, wherein said solvent $S_2$ has an at least 10° C. lower boiling-point than said solvent $S_1$.

3. The coating material according to claims 1 or 2, wherein said solvent $S_2$ has an at least 30° C. lower boiling-point than said solvent $S_1$.

4. The coating material according to claim 1, wherein said microcapsules B are used in amount of 20–70 parts by weight, based on 100 parts by weight of said microcapsules A.

5. The coating material according to claim 1, wherein said microcapsules B are used in an amount of 1–90 parts by weight based on 100 parts by weight of said microcapsules A.

6. A pressure-sensitive recording sheet, which is obtained by coating or printing on a substrate a coating material of microcapsules A and a coating material of microcapsules B either separately or together, said microcapsules A having a volume average particle size of circa 3–15 um and containing a colorless dye and a solvent $S_1$ which dissolves said colorless dye for a pressure-sensitive recording sheet, and said microcapsules B having a volume-average particle size of circa 2–10 um and containing a dye-free solvent $S_2$ which has no ability of dissolving dye and which has a lower boiling point than solvent $S_1$.

* * * * *